US008091934B2

(12) United States Patent
Bair

(10) Patent No.: US 8,091,934 B2
(45) Date of Patent: Jan. 10, 2012

(54) SWIMMING POOL MAINTENANCE APPARATUS

(76) Inventor: Wallace Criley Bair, Atlanta, GA (US)

( * ) Notice: Subject to any disclaimer, the term of this patent is extended or adjusted under 35 U.S.C. 154(b) by 805 days.

(21) Appl. No.: 11/985,138

(22) Filed: Nov. 14, 2007

(65) Prior Publication Data

US 2009/0120857 A1 May 14, 2009

(51) Int. Cl.
*A47F 13/06* (2006.01)

(52) U.S. Cl. ..... 294/24; 294/26; 29/242; 29/243; 29/278; 254/25; 210/167.1

(58) Field of Classification Search ..... 294/19.1, 294/24, 26; 15/1.7, 257.01; 7/161; 254/25, 254/28; 29/242, 243, 278; 210/167.1
See application file for complete search history.

(56) References Cited

U.S. PATENT DOCUMENTS 3,306,448 A * 2/1967 Baker ..... 210/121
3,555,574 A * 1/1971 Stanwood ..... 4/512
3,620,372 A * 11/1971 Ehret ..... 210/167.1
4,818,389 A * 4/1989 Tobias et al. ..... 210/167.12
4,947,466 A * 8/1990 Horiuchi et al. ..... 473/606
5,329,648 A * 7/1994 Davey ..... 4/490
D364,717 S * 11/1995 Trapp ..... D32/42
6,027,639 A * 2/2000 Lenhart et al. ..... 210/108
6,283,519 B1 * 9/2001 Dutton et al. ..... 294/19.1
6,422,623 B1 * 7/2002 Thomas ..... 294/24
6,833,034 B1 * 12/2004 Thomas, Jr. ..... 134/6
6,871,892 B2 * 3/2005 Holman ..... 294/19.1
7,014,231 B1 * 3/2006 Callen ..... 294/24
7,309,088 B2 * 12/2007 Fiore et al. ..... 294/24
2002/0047025 A1 * 4/2002 Ray ..... 222/321.3

OTHER PUBLICATIONS

The Pool Service Company (www.thepoolserviceco.com/cleaning.html), Copyright 2006-2008, Under "Vacuum to filter" pagragraph, lines 4-5. Attached PDF copy, p. 2, Under "Vacuum to filter", lines 4-5.*

* cited by examiner

*Primary Examiner* — Saul Rodriguez
*Assistant Examiner* — Stephen Vu
(74) *Attorney, Agent, or Firm* — Wallace C. Bair, Esq.

(57) ABSTRACT

A swimming pool skimmer maintenance apparatus (10) includes an elongate tubular handle (12) having a hook end (14) and an opposed sealing end (16). The sealing end includes a sealing structure such as a spherical ball (116) defining a sealing surface effective to seal a skimmer suction port to prevent a flow of water through the skimmer suction port. The hook end supports a metal wire hook (32) which extends from the handle and which is adapted to lift a debris collection basket, a skimmer diverter or a skimmer lid present at the skimmer. The apparatus is also useful for safely probing the skimmer for animals or insects.

4 Claims, 6 Drawing Sheets

SWIMMING POOL MAINTENANCE APPARATUS

FIELD OF THE INVENTION

This invention relates to a swimming pool maintenance apparatus and more particularly to an apparatus for servicing a swimming pool skimmer.

BACKGROUND OF THE INVENTION

Modern recreational swimming pools are well known. A swimming pool typically comprises a vessel for containing water and a water circulation system. The vessel is typically a masonry structure but other materials such as fiberglass and vinyl are in common use.

The water circulation system includes a water pump and a filter. The water pump draws water from the vessel through influent pipe in fluid communication with the vessel. The water is then forced through the filter where the water is filtered for debris. The now-filtered water is then returned to the pool through effluent pipe in fluid communication with the vessel.

The influent pipe communicates with the vessel through structures adapted to the vessel. These structures may include a skimmer and a main drain sump. The skimmer is located adjacent the vessel and is configured primarily to cause a thin layer of water adjacent the surface of the water in the vessel to be drawn into the skimmer thereby removing debris floating on the water surface. A typical skimmer in use today is shown in U.S. Pat. No. 3,306,448.

The skimmer includes a mouth that defines a skimmer opening which opens into the vessel at an upper portion of a vessel wall. A horizontally disposed throat extends from the mouth to a skimmer body having a sidewall which defines a vertically extending skimmer bore. A debris collecting skimmer basket is supported in the skimmer bore. The skimmer body includes a suction port adjacent a lower end of the sidewall below the skimmer basket. Influent pipe is adapted to the suction port to provide fluid communication between the skimmer and the pump. Under the influence of the pump water is drawn from the vessel through the skimmer mouth and bore and out through the suction port.

In some skimmers, an equalizer port may also be located adjacent the lower end of the skimmer body sidewall. The equalizer port, if present, may communicate with the vessel through an equalizer pipe extending from the equalizer port and opening into the vessel a foot or more below the skimmer mouth. In another arrangement the equalizer port communicates through a pipe extending to, and in communications with, a main drain sump set at the bottom of the vessel.

The skimmer mouth is located in the vessel sidewall so that the surface of the water coincides generally with the middle of a vertical side wall defining the mouth opening. In modern skimmers, a buoyant, pivoting weir is supported in the opening. The buoyant, pivoting action of the weir causes a thin layer of water adjacent the water surface to be drawn into the skimmer mouth. The pivoting action also accommodates a varying water level in the pool while still providing skimming action.

To protect against situations where the vessel water level is too low to provide an adequate flow through the skimmer mouth a suction diverter may be placed in the skimmer bore in selective sealing engagement with the skimmer body adjacent the suction and equalizer ports. When the water level is so low that water flow through the skimmer mouth is inadequate, thus starving the skimmer, a float in the suction diverter drops. When the float drops fluid communication through the skimmer bore is interrupted and exclusive fluid communication between the equalizer port and the suction port is established. In this condition water will still be drawn from the vessel through the suction port.

Swimming pools must be maintained to keep the water and the vessel in a sanitary, clear and substantially debris-free state. Water clarity and sanitation are maintained by filtration and chemical treatment. Debris residing on the water surface is removed by the flow of water through the skimmer mouth and is captured by the skimmer basket located in the skimmer bore.

Other debris may be submerged within the vessel and supported on the interior vessel surface. The most common method for removing this debris is by a vacuuming process utilizing a vacuuming apparatus. The vacuuming apparatus typically includes a telescoping pole, a vacuum head attached to an end of the pole, and a vacuum hose that provides fluid communication between a vacuum source and an aperture in the vacuum head. Such vacuuming apparatuses are well known. The vacuum source for vacuuming the pool vessel is typically the pool pump which is in fluid communication with the skimmer suction port. A vacuum hose end opposite the vacuum head is adapted to be received in sealing engagement with the skimmer suction port thereby causing water to be drawn through the vacuum hose.

During the vacuuming process an end of the vacuum pole opposite the vacuum head is grasped by a maintenance person. The maintenance person then guides the vacuum head over the interior vessel surface so that the head passes over debris to be removed. Debris is drawn up through the vacuum head aperture and through the hose under the suction of the vacuum source.

The pool maintenance and vacuuming procedure begins by first removing a protective skimmer lid from the skimmer body thus exposing the skimmer bore. Then, the skimmer basket is lifted up and out of the skimmer bore and any debris residing in the basket is conveniently dumped from the basket. The skimmer diverter, if present, is then removed. At this point the skimmer is prepared to receive the vacuum hose end into the skimmer suction port.

The total suction of the pump is distributed between the skimmer and the main drain. When vacuuming the pool it is desirable to maximize the flow of water through the skimmer used for vacuuming. Thus, to maximize the suction flow of water through the skimmer the suction flow from the main drain sump should be shut off. The influent piping communicating with the main drain sump is typically separately valved making it convenient to shut the main drain suction off by simply closing that valve.

It is quite common that more than one skimmer is present. In that case the suction flow to the additional skimmers, but not including the skimmer utilized for vacuuming, should be shut off prior to vacuuming the pool. If the influent pipes communicating with the skimmers are separately valved, then shutting off the flow to the additional skimmers is as easy and convenient as closing the valve associated with each additional skimmer. Once done, the vacuuming process can begin.

In some cases the influent pipes communicating with the skimmers are brought together at a common manifold and only a single valve is provided to control the suction flow from all of the skimmers. Thus, the suction flow through the skimmers not used for vacuuming cannot be shut off selectively by closing a valve. Where this arrangement exists the suction flow through the suction ports of the other skimmers not used for vacuuming must be shut off by other means. A common means for shutting off the suction flow through the skimmers is by obstructing the suction ports with a plugging device.

The above described process of cleaning and preparing the skimmers for vacuuming is not without problems. The process is at the very least inconvenient and at worst, presents dangers to the maintenance person. Skimmer lids are often difficult to remove owing to poor fit and expansion on hot summer days. Also, the skimmer bore and skimmer basket may contain substantial debris that may obscure from view dead or living animals including rodents and snakes. Injuries to maintenance personnel attempting to remove the skimmer basket and diverter by reaching into the skimmer bore with their hands may result from bites from living rodents and snakes present in the skimmer bore but unknown to the maintenance person.

Removing the skimmer basket and diverter requires the maintenance person to get down on hands and knees and then insert his hand into the water residing in the skimmer bore. This may be undesirable especially during cold weather when the water is cold. Additionally, a maintenance person wearing long sleeves and gloves must remove the gloves and roll up his sleeves before reaching inside the skimmer bore for the skimmer basket or diverter. This is annoying and time consuming. Also, in freezing weather this is very uncomfortable and may be potentially injurious.

Another problem occurs when multiple skimmers are present. As explained above, to maximize suction flow through the skimmer used for vacuuming, plugging devices must be provided for plugging the skimmer suction ports on skimmers not used for vacuuming. Various devices such as frustum shaped rubber stoppers, ball-shaped objects, or flat discs may be used for plugging these skimmer suction ports. These devices are often difficult to handle and use because of their size and shape. Another problem is that these plugging devices may be drawn deep into the suction port by the suction source, making removal very difficult. These plugging devices must also be retrieved from the skimmer bore when the vacuuming process is finished thus requiring inserting hands in the water a second time.

What is needed and what is presently unavailable is an apparatus for making the skimmer cleaning and vacuum preparation process more convenient and safe.

SUMMARY OF THE INVENTION

The foregoing described problems associated with swimming pool maintenance have been overcome by the swimming pool maintenance apparatus of the present invention. The apparatus of the present invention provides a versatile device for servicing a swimming pool skimmer and for plugging a suction port of a skimmer not used during the vacuuming process of the swimming pool.

Generally described, a first preferred embodiment of the present invention includes an elongate handle having a sealing end adapted for sealing a skimmer suction port. In an alternative preferred embodiment the apparatus includes a handle having a hook end supporting a hook for engaging and lifting a skimmer lid, a skimmer basket or a skimmer diverter from a skimmer bore. In another alternative preferred embodiment the apparatus of the present invention includes a handle having a hook end that supports a hook for engaging and lifting a skimmer lid, a skimmer basket, or a skimmer diverter from a skimmer bore and an opposed sealing end adapted for sealing a skimmer suction port.

The present invention provides a convenient and safe apparatus for probing the skimmer bore and basket for dangerous debris, including live animals. The present invention further provides an apparatus for servicing the skimmer without a maintenance person having to place his hands in water residing in a skimmer bore.

BRIEF DESCRIPTION OF THE DRAWINGS

Other features of the present invention will be more readily understood from the following detailed description of the specific embodiments thereof when read in conjunction with the accompanying drawings in which like reference symbols designate like parts throughout the Figures and in which.

DETAILED DESCRIPTION OF THE PREFERRED EMBODIMENT

Figure 1:
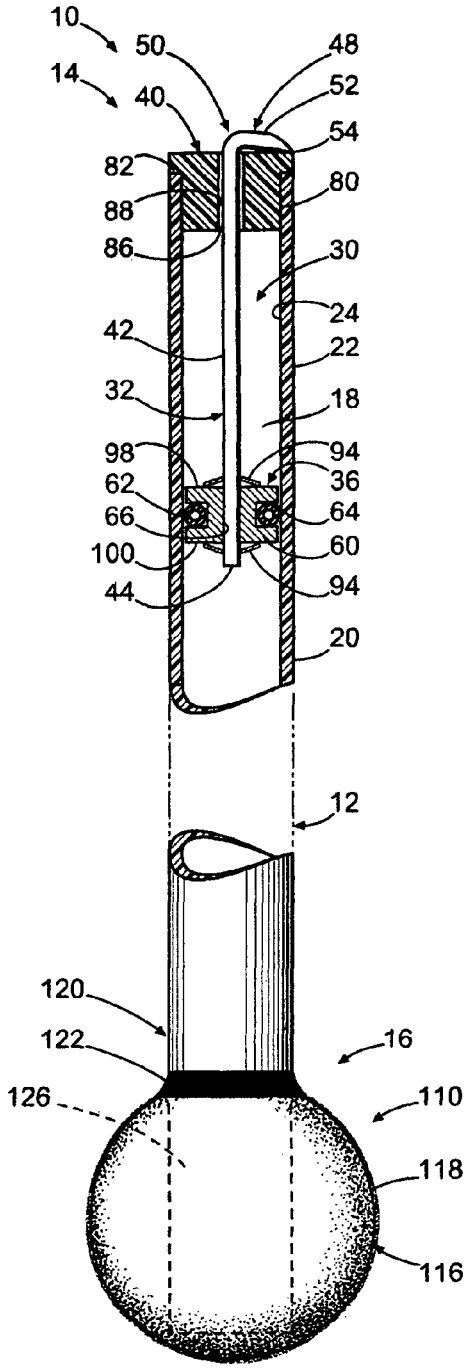
FIG. 1 is a side view, shown in partial cross-section, of the skimmer maintenance apparatus of the present invention.
Figure 2:
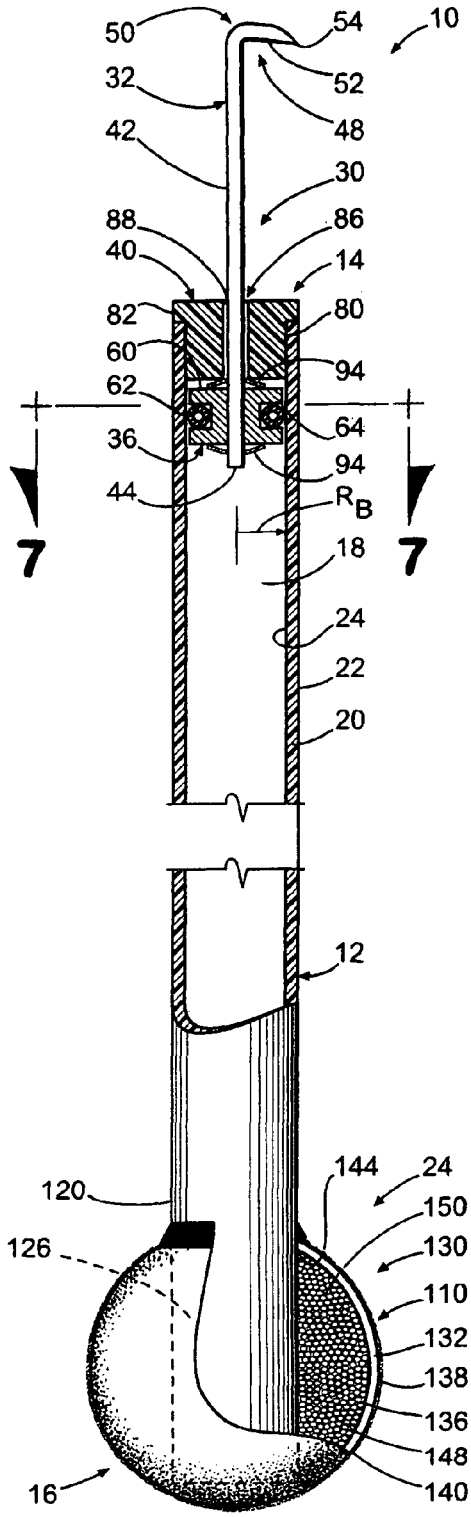
FIG. 2 is a side view, shown in partial cross-section, of an alternative embodiment of the skimmer maintenance apparatus of the present invention.

Referring now to FIGS. 1 and 2 there is shown the pool maintenance apparatus of the present invention, designated generally by the numeral 10. The apparatus 10 includes an elongate handle 12 having a hook end 14 and a sealing end 16. In a preferred embodiment of the present invention the handle 12 is a round, tubular handle having a handle bore 18 defined by a handle sidewall 20. The sidewall 20 includes an outer handle surface 22 and an inner handle surface 24. Although not intended to be limiting in any way, a 1 inch diameter polyvinyl chloride (PVC) pipe provides a suitably sized tube material for the handle 12.

A hook assembly 30 is supported by the handle 12 at the hook end 14. The hook assembly 30 comprises a hook 32, a retainer and is tension assembly 36, and a retainer cap 40. The hook 32 comprises a stem 42 having a retained end 44 and an opposed snag end 48. A snag 50 is formed at the snag end 48 of the stem 42 by displacing a distal portion 52 of the stem 42 at an angle to the stem 42. A snag point 54, is formed at the end of the distal portion 52 of the stem 42. In a preferred embodiment, the stem 42 is fabricated of stainless steel wire or rod having a diameter and temper sufficient to resist bending during use. Thus, a stainless steel, spring temper, wire having a diameter of 0.125 to 0.160 inches has been found to be suitable for fabricating the hook 32.

Figure 7:
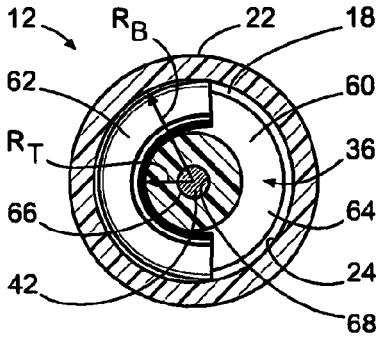
FIG. 7 is a section view of a retainer assembly taken along lines 7-7, shown in FIG. 2.
Figure 8:
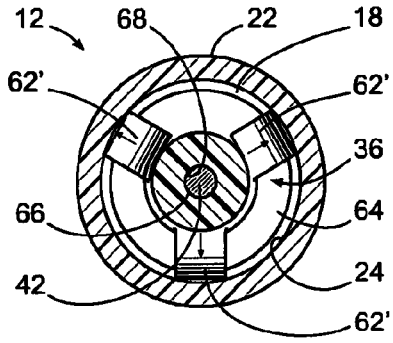
FIG. 8 is a section view of an alternative retainer assembly taken along lines 7-7, shown in FIG. 2.

Looking now at FIGS. 2, 7 and 8 the retainer and tension assembly 36 includes a spool 60 and a tension tube 62 received in an annular groove 64 of the spool 60. The spool 60 is disk shaped having a diameter sized to allow the spool 60 to slide freely within the handle bore 18 of the handle 12 adjacent the inner handle surface 24. The spool 60 includes a stem receiving bore 66 defined by a bore surface 68 disposed coaxially about a central axis of the spool 60. The stem receiving bore diameter is sized to receive the retained end 44 of the hook stem 42.

The annular groove 64 is sized and configured to receive the tension tube 62 within the annular groove 64. In a first embodiment shown in FIG. 7 the length of the tension tube 62 is substantially longer than its diameter and has a radius of curvature $R_T$ greater than the radius of curvature $R_B$ of the inner handle surface 24 of the handle 12. In a second embodiment shown in FIG. 8 the tension tube comprises one or more short tubes 62' having a length approximately equal to the diameter of the tube 62.' The tension tubes 62 or 62' are preferably fabricated of pliable plastic tubing such as polyethylene.

The retainer cap 40 includes a shoulder 80 sized to be received within the bore 18 of the handle 12 adjacent the hook end 14. A boss 82 extends outwardly from the shoulder 80 to provide a stop to locate the retainer cap 40 at a depth within the handle bore 18 of the handle 12. The retainer cap 40 includes a cap stem guide bore 86, defined by a cap bore sidewall 88, which is coaxially disposed along a central axis of the retainer cap 40. The diameter of the stem guide bore 86 is sized to provide a clearance fit between the hook stem 42 and the bore sidewall 88.

The component parts of the hook assembly 30 may be assembled by first placing the retained end 44 of the stem 42 through the cap stem guide bore 86 of the retainer cap 40 such that the snag 50 is adjacent the boss 82. The retained end 44 of the hook stem 42 is then inserted through the stem receiving bore 66 of the spool 60 so that a short portion of the retained end 44 extends outside the stem receiving bore 66. The retained end 44 is then caused to be permanently retained within the stem receiving bore 66 by any one of many well-known means. One such means for retaining the retained end 44 within the stem receiving bore 66 is by employing a glue such as an epoxy applied between the retained end 44 of the stem 42 and the bore surface 68. An alternative means for securing the retained end 44 of the stem 42 within the stem receiving bore 66 is to employ opposed cooperating push retainer nuts 94, shown in FIGS. 1 and 2. The push retainer nuts 94 are supported on the stem 42 and disposed in compressive engagement with opposed ends 98 and 100 of the spool 60 in a conventional manner. The tension tube 62 or 62' is then placed within the annular groove 64.

The hook assembly 30, now completely assembled, is inserted into the handle bore 18. The shoulder 80 of the retainer cap 40 is then secured in engagement with the inner handle surface 24 of the handle sidewall 20 by gluing, pins or other well known means.

With the hook assembly 30 secured to the hook end 14 of the handle 12 the hook 32 can be telescopically extended and retracted from the handle 12. The hook 32 is desirably maintained at a preferred position and orientation of the hook snag 50 because of holding forces provided by the engagement of the tension tube 62 or 62' with the inner handle surface 24 of the handle 12. If the longer tension tube 62 is selected for use, the tension tube 62 attempts to attain a radius of curvature $R_T$ greater than the radius of curvature $R_B$ of the handle bore 24. Thus, the opposed ends of the tension tube 62 compressively engage the inner handle surface 24 creating a friction force against that surface which tends to maintain the spool 60, and thus the hook 32, at a desired position relative to the retainer cap 40. The length and material properties of the tube 62 are chosen to provide an appropriate holding force yet to allow easy extension and retraction of the hook 32 from the handle bore 18.

When the short extension tubes 62' are selected for use to provide tension on the retainer and tension assembly 36, a plurality of tubes 62' is disposed within the annular groove 64. The tubes 62' are equally angularly displaced from each other so as to cause the spool 60 to be maintained in the center of the bore 18 of the handle 12. The tubes 62' compressively engage the inner handle surface 24 of the handle 12 and the spool 60 causing the roundness of the tubes 62' to slightly deform when the hook assembly 30 is assembled and disposed within the handle bore 18. The compressive engagement of the tubes 62' with the inner handle surface 24 causes a holding force against the spool 60 which tends to maintain the spool 60 and the hook 32 at a desired displacement and orientation relative to the retainer cap 40.

Alternative hook assemblies within the scope of the invention but not shown exist. One such alternative includes a hook assembly having a hook mounted outside the handle 12 adjacent the tube surface 22 with a suitable retainer so that the hook extends and retracts adjacent the hook end 14 or is held in a fixed position relative to the hook end 14.

Referring again to FIGS. 1 and 2, the sealing end 16 of the handle 12 includes a sealing structure 110 adapted to seal a skimmer suction port as will be explained in detail below. In the alternative preferred embodiments, shown in FIGS. 1 and 2, the sealing structure 110 is a spherically shaped body. Other alternative embodiments of the sealing structure 110 within the scope of the present invention may include configurations such as a cone shaped structure or a frustum shaped structure for example.

As shown in FIG. 1 the sealing structure 110 is a solid core ball 116 having a sealing surface 118. A distal end 120 of the handle 12 is secured in engagement with the solid core ball 116 by alternative means. One means is to secure the distal end 120 of the handle 12 to the sealing surface 118 of the solid ball 116 by using an epoxy 122 or thermoplastic bonding material or by welding. Alternatively, a cavity 126 may be provided within the solid ball 116. The cavity 126 is sized to receive the distal end 120 of the handle 12. A suitable adhesive or other means within the scope of the present invention may be used to secure the distal end 120 within the cavity 126 in a conventional manner. Another means for providing a solid core ball 116 as the sealing structure 110 would be to mold the solid core ball 116 about the distal end 120 of the handle 12 by a suitable molding process.

The sealing structure 110 may alternatively be provided by a hollow body such as a hollow ball 130 shown in FIG. 2. A conventional tennis ball is particularly well suited for use as the hollow ball 130. It is environmentally desirable and responsible to make use of used or manufacturing reject tennis balls in the assembly of the apparatus 10. The use of used or manufacturing reject tennis balls prevents the immediate disposal problems of those balls and thus provides a stage of recycling.

The hollow ball 130 includes a sidewall 132 having an inner sidewall surface 136 and an outer sidewall sealing surface 138. If a conventional tennis ball is chosen as the hollow ball 130 a short nap felt material layer 140 is disposed in engagement with the outer sidewall sealing surface 138. The handle 12 may be attached to the hollow ball 130 by surface gluing the end 120 of the handle 12 to the felt material layer 140 or the outer sidewall sealing surface 138 similar to the attachment of the handle 12 to the solid ball 116 shown in FIG. 1.

It should be appreciated however that the hollow ball 130 may become punctured during use or, in the case of utilizing a used tennis ball, may already be punctured. If punctured, the rigidity of the sidewall 132 may not be sufficient to prevent the sidewall 132 from collapsing under the suction force presented by the skimmer suction port as will be explained in detail below. If the sidewall 132 collapses the hollow ball 130 could be drawn deep within the skimmer suction port and possibly permanently obstruct the skimmer suction port or make removal of the hollow ball 130 from the skimmer suction port very difficult.

To avoid the problem of obstructing the skimmer suction port with a collapsed hollow ball 130 an alternative, shown in FIG. 2, includes securing the distal end 120 of the handle 12 within a cavity defined within the hollow ball 130. More particularly the distal end 120 is shown passing through an aperture 144 formed in the sidewall 132 of the hollow ball 130. A void 148 is thus defined between the outer handle surface 22 of the handle 12 and the inner sidewall surface 136 of the hollow ball 130. A fill material 150 of suitable composition is provided to fill the void 148. The fill material 150 desirably secures the end 120 of the handle 12 within the hollow ball 130 and supports the sidewall 132 to help prevent deflection of the sidewall 132 when the apparatus is used to plug the skimmer suction port.

Figures 3, 3A:
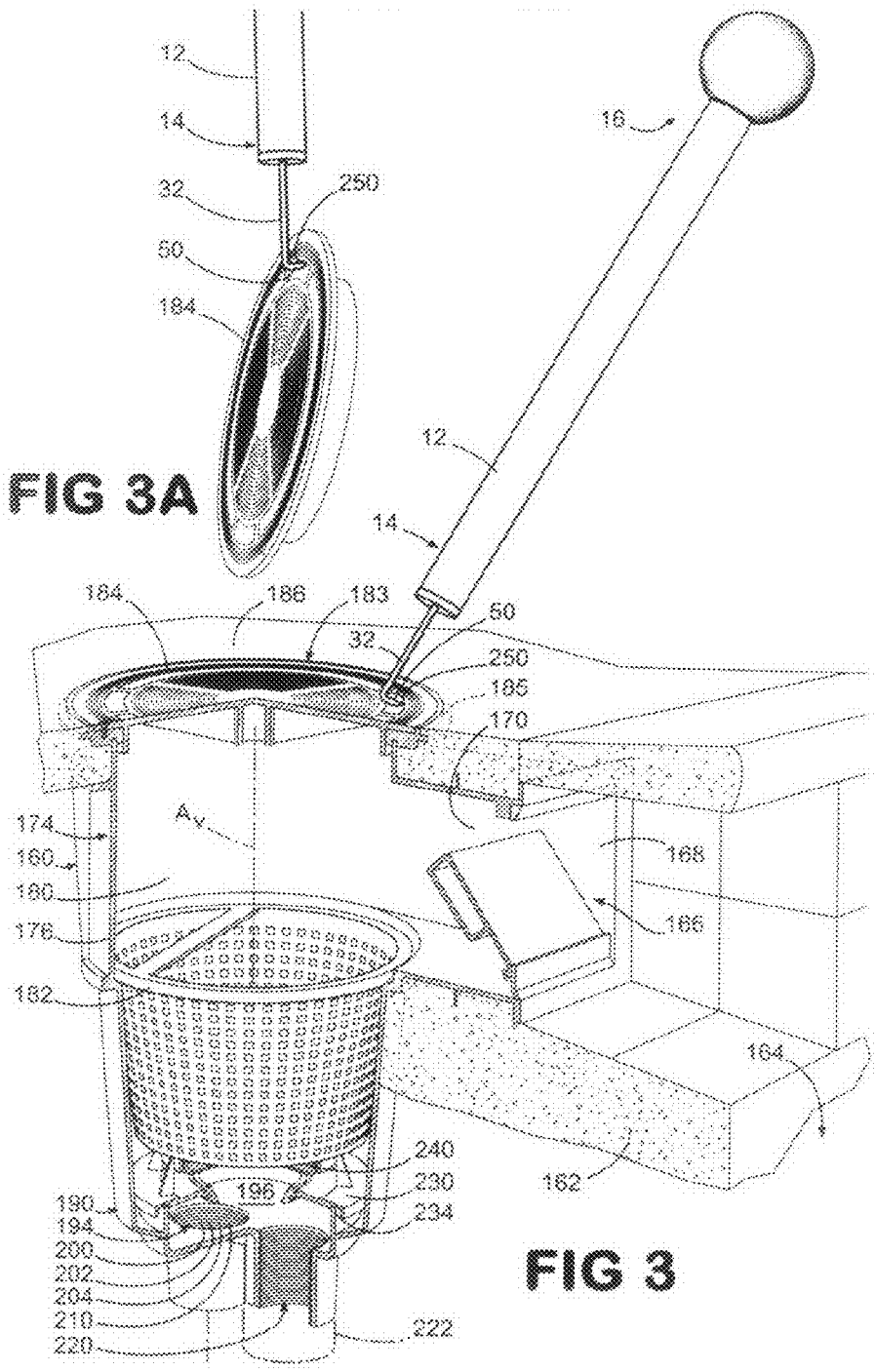
FIG. 3 is cross-sectional perspective side view of a swimming pool skimmer closed by a skimmer lid and the skimmer maintenance apparatus engaging the skimmer lid prior to removal.
FIG. 3*a* is a perspective side view of a swimming pool skimmer lid and the skimmer maintenance apparatus supporting the skimmer lid above the skimmer.

As described above the pool maintenance apparatus 10 is used for servicing a swimming pool skimmer. A pool skimmer is shown in FIGS. 3 and 3*a*, 4 and 4*a*, 5 and 5*a*, 6 and 9 and is depicted generally by the numeral 160. In FIG. 3 the skimmer 160 is shown set into a sidewall 162 of a swimming pool vessel 164. The skimmer 160 includes a skimmer mouth 166 which defines a skimmer opening 168 which opens into the vessel 164 at an upper portion of the vessel sidewall 162. A horizontally disposed throat 170 extends from the mouth 166 to a skimmer body 174 having a sidewall 176 which defines a vertically extending skimmer bore 180. A debris collection skimmer basket 182 is shown supported in the skimmer bore 180. A skimmer lid assembly 183 includes a skimmer lid 184 and a lid support collar 185 that is set into a portion of an adjacent pool deck 186. The lid support collar 185 opens into the skimmer bore 180. The skimmer bore 180 is closed by the skimmer lid 184 which is received and supported by the lid support collar 185.

The skimmer body 174 includes a suction port adjacent a lower end 190 of the sidewall 176. As shown in FIG. 3 a suction port 194 is shown adapted to a manifold 196. The suction port 194 includes an opening 200 defined by the manifold 196 and a bore 202 defined by a threaded sidewall 204 and having a generally vertically extending central axis. The manifold 196 includes a circumferentially extending sealing edge 210 adjacent the opening 200. The threaded sidewall 204 is sized to receive male threaded fittings in two common sizes, 1.5 and 2 inch NPT.

Some swimming pool skimmers include suction ports having a bore defining a generally horizontally arranged bore axis. Looking at FIG. 9 there is shown a pool skimmer 160 having a skimmer suction port 212 which includes a bore 214 defined by a port sidewall 215 adjacent the lower end 190 of the sidewall 176. In the skimmer 160 shown in FIG. 9 the bore 214 defines a generally horizontally extending bore axis $A_H$. The port 212 opens through the sidewall 176 and includes a sealing edge 216.

Figures 4, 4A:
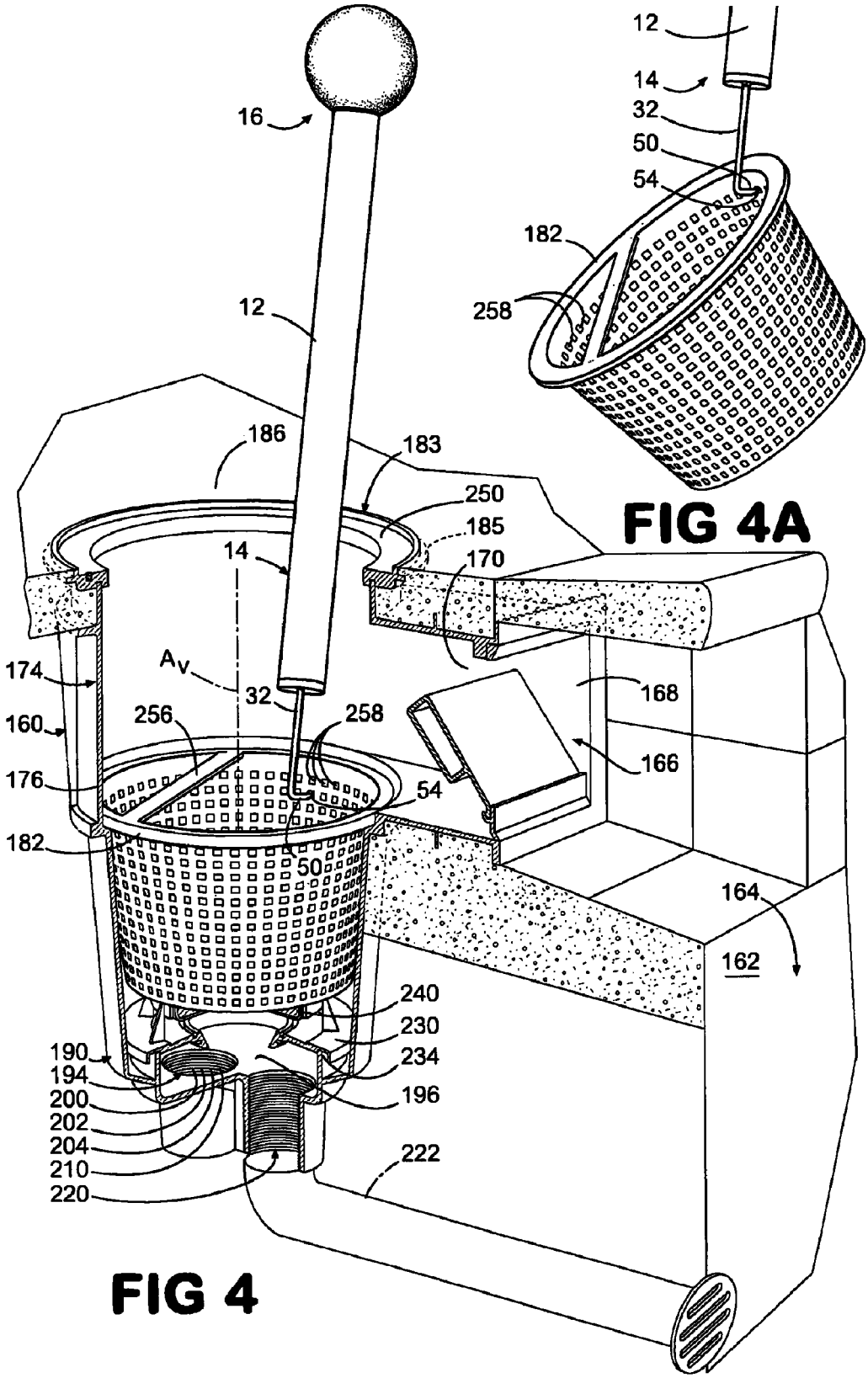
FIG. 4 is a cross-sectional perspective side view of a swimming pool skimmer and the skimmer maintenance apparatus being used to engage a skimmer basket residing within the skimmer.
FIG. 4*a* is a perspective side view of the skimmer maintenance apparatus supporting the skimmer basket above the skimmer.

In the skimmer 160 shown in FIG. 4 an equalizer port 220 is shown adapted to the manifold 196 adjacent the suction port 194. The equalizer port 220 is typically adapted for fluid communication with the pool vessel 164 through an equalizer pipe 222 extending from the equalizer port 220 and opening into the pool vessel 164 a foot or more below the skimmer mouth 166. In another skimmer arrangement the equalizer port 220 communicates through the equalizer pipe 222 which extends to and is in communication with a main drain sump set at the bottom of the pool vessel 164, not shown.

Figure 5A:
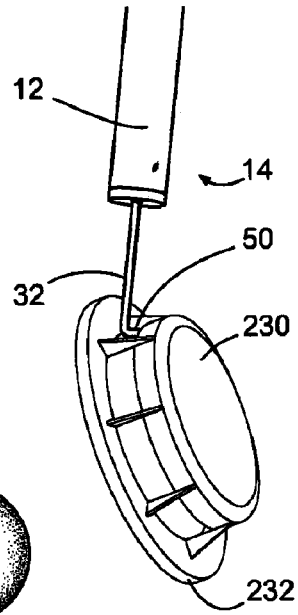
FIG. 5*a* is a perspective view of the skimmer maintenance apparatus supporting the skimmer diverter above the skimmer.
Figure 5:
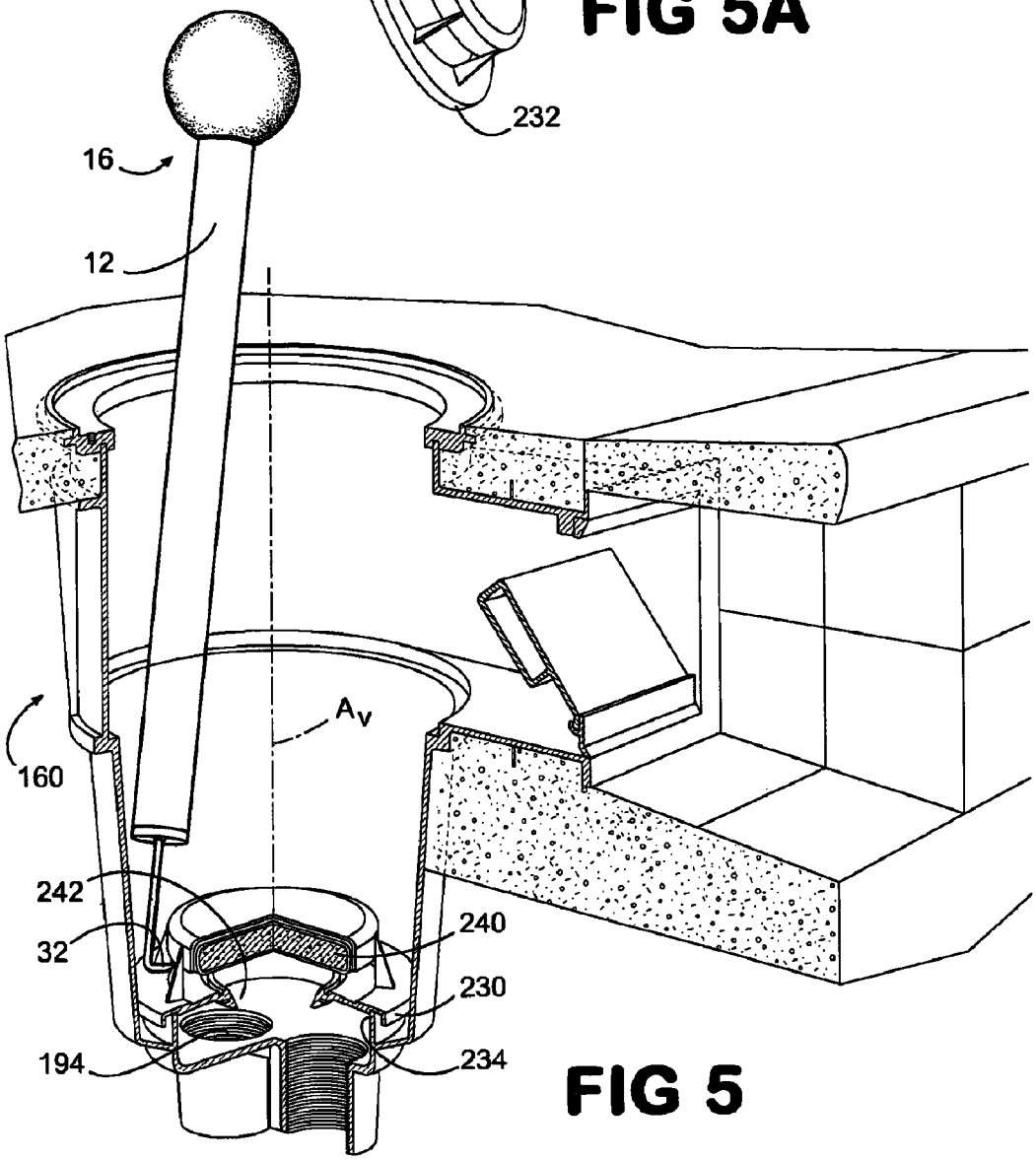
FIG. 5 is a cross-sectional perspective side view of a swimming pool skimmer and the skimmer maintenance apparatus engaging a skimmer diverter prior to removal.

The skimmer 160 shown in FIGS. 3 and 4 further includes a diverter 230 shown most clearly in FIG. 5. The diverter 230 includes an outer rim 232 that is configured to seal along a manifold shoulder 234 adjacent the manifold 196 above the suction and equalizer ports 194 and 220, respectively. Under normal operation the water level in the vessel is sufficient to supply the suction port 194 with an adequate flow of water through the skimmer mouth 166 of the skimmer 160. If the water level in the vessel is too low an inadequate flow condition will occur such that the skimmer bore 180 and suction port 194 are starved for water thus allowing air to pass into the suction port 194. To prevent starvation, a float 240 within the diverter 230 is adapted to drop downwardly and seal a diverter port 242. With the diverter port 242 sealed, the flow of water through the skimmer mouth 166 and the skimmer bore 180 is interrupted. Simultaneously, exclusive fluid communication between the equalizer port 220 and the suction port 194 is established thereby resulting in a continuity of water flow from the pool vessel 164 into the suction port 194.

Having described the present invention 10 and the structure and general operation of the pool skimmer 160, the use of the skimmer maintenance apparatus 10 for servicing the pool skimmer 160 may now be appreciated.

As is depicted in FIGS. 3 and 3*a*, the maintenance of the skimmer 160 begins by removing the skimmer lid 184 to expose the skimmer bore 180. Lid removal utilizing the apparatus 10 is accomplished by first extending the hook 32 from the handle 12. The hook 32 extends telescopically from the handle bore 18 and is held in place at a preferred position and orientation of the snag 50 under tension provided by the retainer and tension assembly 36.

While grasping the apparatus 10 adjacent the sealing end 16 the skimmer lid 184 is engaged by causing the snag 50 to extend into a lid finger aperture 250 defined in the lid 184. The lid 184 is then lifted from engagement with the lid support collar 185 and placed aside.

The hook 32 may then be used to probe the skimmer bore 180 where debris may be present. The snag 50 is effective to engage debris, including animals, sticks and leaves, and to lift the debris from the bore.

In FIGS. 4 and 4*a* the skimmer basket 182 is shown being engaged, lifted and removed from the skimmer bore 180 by use of the maintenance apparatus 10. Ordinarily the skimmer basket 182 includes a basket handle 256 which is easily engaged by the snag 50 for lifting the skimmer basket 182 from the bore 180. Often, however, the basket handle 256 is missing from the basket 182. In that case, the snag point 54 of the snag 50 may be thrust into any one of a plurality of flow-through apertures 258 defined in the skimmer basket 18 commonly present in different skimmer basket makes and models. The snag point 54 is tapered sufficiently to allow the snag point 54 to pass into the flow-through apertures 258 of skimmer baskets without damaging the skimmer basket 18. The snag point 54 is not brought to a sharp tip but, rather, is blunted to prevent injury to the user.

In FIGS. 5 and 5*a* the skimmer diverter 230 is shown being engaged and lifted from engagement with the manifold 196 by the hook 32 of the apparatus 10. The diverter 230 is then lifted from the bore 180 and placed aside. Removing the diverter 230 exposes the suction port opening 200 so that the end of a vacuum hose can be received within the suction port opening 200 as explained in detail above.

Figure 6:
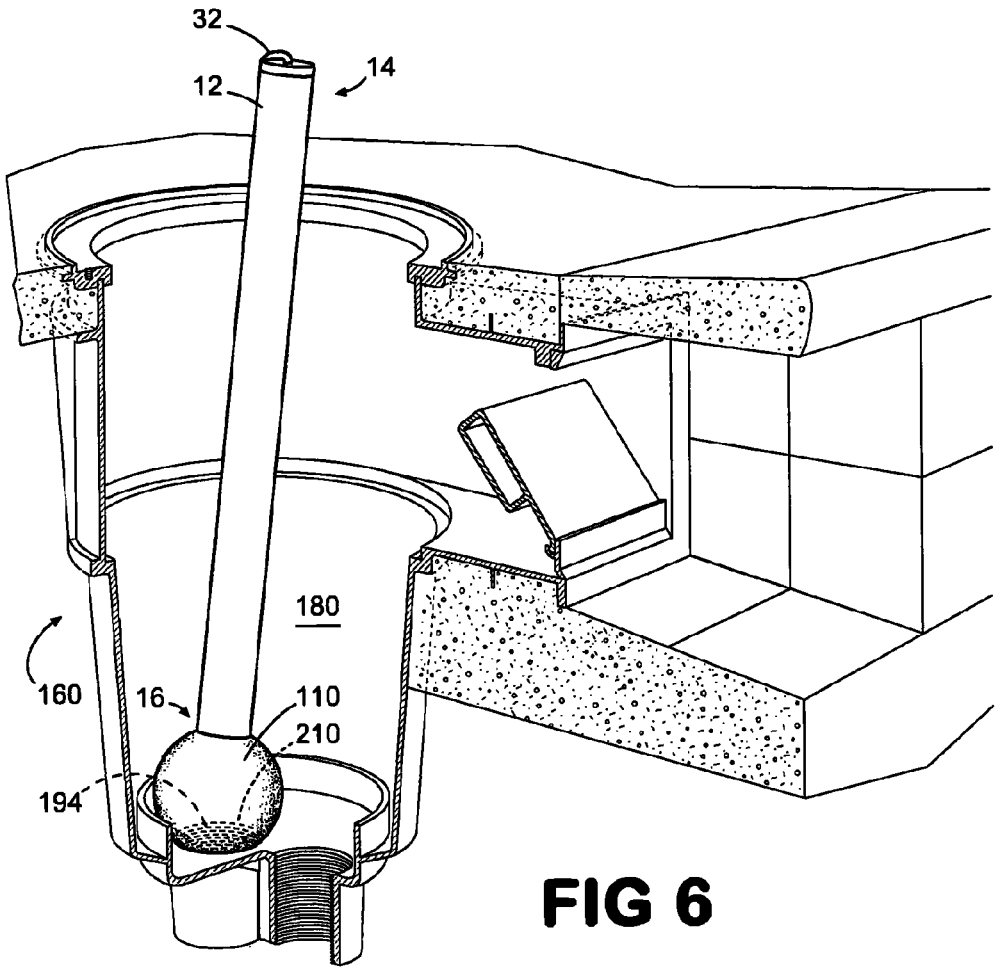
FIG. 6 is a cross-sectional perspective side view of a swimming pool skimmer and the skimmer maintenance apparatus being used to plug the skimmer suction port.
Figure 9:
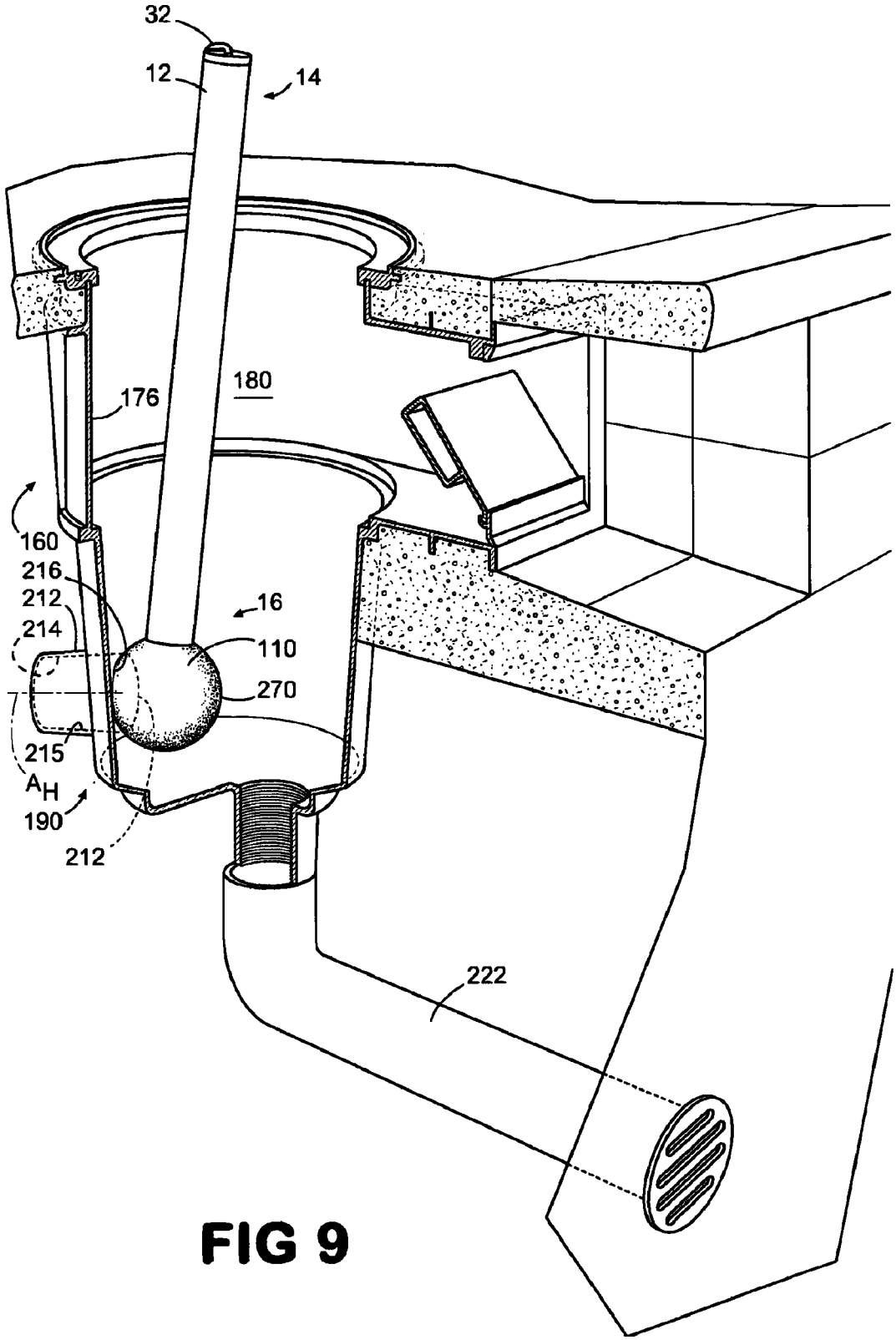
FIG. 9 is a cross-sectional perspective side view of a swimming pool skimmer and the skimmer maintenance apparatus being used to plug the skimmer suction port located in the sidewall of the skimmer body.

If the maintenance process continues with the vacuuming process and there is more than one skimmer present then the other skimmers not used for vacuuming must be plugged. In that case the sealing end 16 of the apparatus 10 may be used to plug the suction ports 194 or 212 of those skimmers. As is shown in FIGS. 6 and 9 the hook 32 is first pushed into the handle bore 18 to prevent injury to the user. The apparatus 10 is grasped adjacent the hook end 14 and then the sealing end 16 is introduced into the skimmer bore 180. The outer sealing surface 138 of the sealing structure 110 is then caused to be placed in sealing engagement with the sealing edge 210 or 216 thereby plugging the suction port 194 or 212, respectively, and stopping water flow there through. In FIG. 9 the skimmer suction port 212 is shown being sealed by the sealing structure 110 by engaging a waist portion 270 of the outer sealing surface 138 of sealing structure 110 with the suction port sealing edge 216.

It is noted at this point that the sealing structure 110 must have a minimum diameter sufficient to seal the suction port 194 but be large enough so that the sealing structure 110 is not drawn deep within the skimmer suction port 194 making its removal difficult. As describe previously, the common, sizes of the suction port 194 are 1.5 or 2 inch NPT. The larger of these two sizes, 2 inch NPT, has a pitch diameter of about 2.27 inches adjacent the sealing edge 210. Where the sealing structure 110 comprises a solid core ball 116 or a hollow ball 130 the diameter should be larger than 2.27 inches, preferably about 2.50 inches. The diameter of a regulation tennis ball is between 2.5 and 2.63 inches thus making it a desirable choice for the hollow ball 130 sealing structure.

If the sealing structure 110 is a tennis ball 130, twisting the handle 12 as the tennis ball 130 engages the sealing edge 210 will cause the napped felt layer 140 to thread into the threaded sidewall 204 causing interfering mechanical engagement of the felt layer 140 and the threaded sidewall 204 thereby acting to secure the sealing structure 110 within the sealing aperture 200.

It should be noted that the length of the handle 12 is sized so that the hook end 14 extends upwardly past the level of the water in the skimmer bore 180 and the lid support collar 185 when the apparatus 10 is used to plug the suction port 194. Also, the pool maintenance apparatus 10 is preferably fabricated so that it is positively buoyant. The positive buoyancy prevents the apparatus 10 from sinking if it is inadvertently dropped in the water and provides other benefits explained in detail below.

It is not uncommon while vacuuming a swimming pool vessel to lose the suction force at the suction port 194 for example. This suction loss may occur for example when the vacuuming head of the vacuuming apparatus is lifted from the pool vessel and placed into an adjacent vessel of water such as an adjacent spa vessel so that the spa vessel can be cleaned by vacuuming. Air is thus drawn into the suction aperture of the vacuum head while the vacuum head is out of the water and being moved between the vessels. The air, now entrained in the vacuum hose, makes its way to the system pump causing the pump to briefly lose prime. With the suction force lost any skimmer suction ports previously plugged by the apparatus 10 may become unplugged since it is generally the suction force that holds the outer sealing surface 138 of the sealing structure 110 in sealing engagement with the sealing edge 210 of the suction port 194. It would be advantageous that the maintenance person knew as quickly as possible whether the skimmer suction port has become unplugged so that the maintenance person could endeavor as quickly as possible to replug the suction port 194. Advantageously, the apparatus 10 of the present invention is adapted to provide a visual cue to the maintenance person that the skimmer suction port has become unplugged as described below.

When the apparatus 10 is used to plug a skimmer suction port the initial orientation of the handle 12, relative to the skimmer bore 180, is established by the maintenance person and then is maintained by the engagement of the sealing structure 110 with the sealing edge 210, for example, of the skimmer 160 because of the mechanical engagement and friction forces between the sealing edge 210 and the outer sealing surface 138 of the sealing structure 110. Thus, if the maintenance person initially orients the handle 12 substantially vertically within the skimmer bore 180, for example, the handle 12 will remain in that orientation as long as a sufficient suction force within the suction port 194 acts on the sealing structure 110. If the suction force in the suction port 194 is reduced or lost completely the sealing structure 110 may be released from engagement with the sealing edge 210 allowing the apparatus 10 to float up in the skimmer bore 180 owing to the buoyancy of the apparatus 10. The height of the handle 12 extending above the lid support collar 185 and the orientation of the handle 12 will change giving visual indication that the apparatus 10 is no longer in sealing engagement with the sealing edge 210. Alternatively, the handle 12 may tip from the initial vertical orientation when the suction force is lost thus providing a visual cue that the sealing structure 110 is no longer plugging the suction port 194.

It is understood that the above-described arrangements are simply illustrative of the invention. Other arrangements may be devised by those skilled in the art which will embody the principles of the invention and fall within the scope and spirit thereof.

What is claimed is:

1. A swimming pool skimmer maintenance apparatus for servicing a swimming pool skimmer adapted to a swimming pool vessel, the skimmer including a skimmer mouth defining a mouth opening into the swimming pool vessel, a throat defining a passageway in fluid communication with the skimmer mouth, a skimmer body defining a bore in fluid communication with the swimming pool vessel through the throat, said skimmer maintenance apparatus comprising:

an elongate handle having a first end and an opposed hook end, said hook end supporting a hook extending longitudinally from said handle, said hook comprising an elongate hook stem having a retained end and a snag end, said retained end being in supported engagement with said handle and said snag end comprising a snag extending substantially perpendicularly from said stem, and wherein said snag includes a tapered snag point formed opposite said hook stem;

a retaining assembly for retaining said retained end of said stem in telescopic engagement with said handle, said retaining assembly being adapted to support said hook so that said snag extends outwardly from the hook end of said handle in a first operating mode and resides adjacent to said handle end in a second operating mode, wherein said retaining assembly includes tension means for supporting said snag in a desired operating position relative to said handle after said snag is urged into the desired operating position; and said handle is a tubular handle comprising a handle sidewall having an outer handle surface and an inner handle surface defining a bore extending along a portion of said handle, and wherein said retainer assembly includes a spool having first and second opposed ends, each of said opposed ends defining an end surface thereat, a stem receiving bore extending between said opposed ends and opening into said end surfaces and an annular groove extending about said spool body, and wherein said tension means includes a tension tube adapted to reside within said annular groove, said retained end of said hook stem being disposed within said stem receiving bore and maintained in engagement therewith and further, wherein said spool is adapted and configured to be disposed within said bore of said handle such that said tension tube compressively engages portions of said inner handle surface and said spool when said retainer assembly is disposed within said bore of said handle, such that said hook extends telescopically from said hook end of said handle so that said snag of said hook can be maintained at a desired placement from the hook end of said handle.

2. The apparatus of claim 1, wherein said retainer assembly further includes a retainer cap having first and second opposed ends, each of said opposed ends defining an end surface thereat, a cap stem guide bore extending between said opposed ends and opening into said first and second end surfaces, said retainer cap being adapted to be held rigidly adjacent the hook end of said handle and said cap stem guide bore being sized and configured to slidingly receive said hook stem there through such that said retainer cap retains said hook and spool assembly within said bore of said handle when said hook stem is moved telescopically relative to the handle bore.

3. A swimming pool skimmer maintenance apparatus for servicing a swimming pool skimmer adapted to a swimming pool vessel, the skimmer including a skimmer mouth defining a mouth opening into the swimming pool vessel, a throat defining a passageway in fluid communication with the skimmer mouth, a skimmer body defining a bore in fluid communication with the swimming pool vessel through the throat, said skimmer maintenance apparatus comprising:

an elongate handle having a first end and an opposed hook end, said hook end supporting a hook extending longitudinally from said handle and being adapted and configured for servicing the swimming pool skimmer wherein said hook comprises an elongate hook stem having a retained end and a snag end, said retained end being in supported engagement with said handle and said snag end comprising a snag extending at an angle from said hook end stem, said swimming pool maintenance apparatus further including a retaining assembly for retaining said retained end of said hook end stem in telescopic engagement with said handle, said retaining assembly being adapted to support said hook so that said snag extends outwardly from the hook end of said handle in a first operating mode and resides adjacent to said handle end in a second operating mode, said retaining assembly including tension means for supporting said snag in a desired operating position relative to said handle; and wherein said handle is a tubular handle comprising a handle sidewall having an outer handle surface and an inner handle surface defining a bore extending along a portion of said handle, and wherein said retainer assembly includes a spool having first and second opposed ends, each of said opposed ends defining an end surface thereat, a stem receiving bore extending between said opposed ends and opening into said end surfaces and an annular groove extending about said spool body, and wherein said tension means includes a tension tube adapted to reside within said annular groove, said retained end of said hook stem being disposed within said stem receiving bore and maintained in engagement therewith and further wherein said spool is adapted and configured to be disposed within said bore of said handle such that said tension tube compressively engages portions of said inner handle surface and said spool when said retainer assembly is disposed within said bore of said handle such that said hook extends telescopically from said hook end of said handle so that said snag of said hook can be maintained at a desired displacement from the hook end of said handle.

4. The apparatus of claim 3 wherein said retainer assembly further includes a retainer cap having first and second opposed ends, each of said opposed ends defining an end surface thereat, a cap stem guide bore extending between said opposed ends and opening into said first and second end surfaces, said retainer cap being adapted to be held rigidly adjacent the hook end of said handle and said cap stem guide bore being sized and configured to slidingly receive said hook stem there through such that said retainer cap retains said hook and spool assembly within said bore of said handle when said hook stem is moved telescopically relative to the handle bore.

* * * * *